US006240572B1

(12) United States Patent
Van Der Gaag et al.

(10) Patent No.: US 6,240,572 B1
(45) Date of Patent: Jun. 5, 2001

(54) TOILET BOWL SANITIZING APPARATUS

(76) Inventors: Leonard C. Van Der Gaag, 336 Hedge Hope Dr., Las Vegas, NV (US) 89123; Arthur C. Krahmer, 3802 Pardee Ct., El Dorado Hills, CA (US) 95762

( * ) Notice: Subject to any disclaimer, the term of this patent is extended or adjusted under 35 U.S.C. 154(b) by 0 days.

(21) Appl. No.: 09/502,304

(22) Filed: Feb. 11, 2000

(51) Int. Cl.[7] ..... E03D 9/00
(52) U.S. Cl. ..... 4/225.1; 4/222
(58) Field of Search ..... 4/225.1, 222, 224, 4/223

(56) References Cited

U.S. PATENT DOCUMENTS

| | | | | |
|---|---|---|---|---|
| 1,170,387 | * | 2/1916 | Andrews | 4/225.1 |
| 3,228,040 | * | 1/1966 | Currie | 4/225.1 |
| 4,993,084 | * | 2/1991 | McCauley et al. | 4/224 |
| 5,125,119 | * | 6/1992 | Munoz | 4/213 |
| 5,673,439 | * | 10/1997 | Kuo | 4/222 |
| 5,745,928 | * | 5/1998 | Armanno, Sr. | 4/225.1 |
| 5,815,850 | * | 10/1998 | Shon | 4/225.1 |
| 5,881,396 | * | 3/1999 | Rivera | 4/225.1 |

* cited by examiner

*Primary Examiner*—Gregory L. Huson
*Assistant Examiner*—Huyen Le

(57) ABSTRACT

A toilet bowl sanitizing apparatus for sanitizing water in the toilet bowl. The toilet bowl sanitizing apparatus includes a toilet bowl sanitizing apparatus for mounting in a toilet. The toilet has a tank with an interior for selectively holding flushing water and a fill valve for controlling water flow from a water supply to the tank. A lever coupled to a float controls the fill valve. An upstanding overflow container is mounted in the tank and empties into a tank outlet. A trickle conduit is in communication with the fill valve for squirting water into the overflow container. The tank outlet is in fluid connection with a toilet bowl. The apparatus comprises a container which has a first end, a second end and a substantially hollow peripheral extending wall therebetween. The first end of the container has an opening therein and the second end is closed. A cap is adapted for mounting over the opening in the container. An intake pipe brings water into the container. The intake pipe is fluidly connected to the container. The trickle conduit has end adapted for connecting to the intake pipe. An outlet pipe is fluidly connected to the container. A plurality of sanitizing tablets sanitizes water flowing through the container. The outlet pipe is adapted for being placed in the overflow container.

6 Claims, 3 Drawing Sheets

TOILET BOWL SANITIZING APPARATUS

BACKGROUND OF THE INVENTION

1. Field of the Invention

The present invention relates to toilet water sanitizers and more particularly pertains to a new toilet bowl sanitizing apparatus for sanitizing water in the toilet bowl.

2. Description of the Prior Art

The use of toilet water sanitizers is known in the prior art. More specifically, toilet water sanitizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,745,928; U.S. Pat. No. 3,135,969; U.S. Pat. Des. No. 961,650; U.S. Pat. No. 5,603,126; U.S. Pat. No. 3,563,384; and U.S. Pat. Des. No. 345,196.

While these devices fulfill their respective, particular objectives and requirements, the aforementioned patents do not disclose a new toilet bowl sanitizing apparatus. The inventive device includes a toilet bowl sanitizing apparatus for mounting in a toilet. The toilet has a tank with an interior for selectively holding flushing water and a fill valve for controlling water flow from a water supply to the tank. A lever coupled to a float controls the fill valve. An upstanding overflow container is mounted in the tank and empties into a tank outlet. A trickle conduit is in communication with the fill valve for squirting water into the overflow container. The tank outlet is in fluid connection with a toilet bowl. The apparatus comprises a container which has a first end, a second end and a substantially hollow peripheral extending wall therebetween. The first end of the container has an opening therein and the second end is closed. A cap is adapted for mounting over the opening in the container. An intake pipe brings water into the container. The intake pipe is fluidly connected to the container. The trickle conduit has end adapted for connecting to the intake pipe. An outlet pipe is fluidly connected to the container. A plurality of sanitizing tablets sanitizes water flowing through the container. The outlet pipe is adapted for being placed in the overflow container.

In these respects, the toilet bowl sanitizing apparatus according to the present invention substantially departs from the conventional concepts and designs of the prior art, and in so doing provides an apparatus primarily developed for the purpose of sanitizing water in the toilet bowl.

SUMMARY OF THE INVENTION

In view of the foregoing disadvantages inherent in the known types of toilet water sanitizers now present in the prior art, the present invention provides a new toilet bowl sanitizing apparatus construction wherein the same can be utilized for sanitizing water in the toilet bowl.

The general purpose of the present invention, which will be described subsequently in greater detail, is to provide a new toilet bowl sanitizing apparatus apparatus and method which has many of the advantages of the toilet water sanitizers mentioned heretofore and many novel features that result in a new toilet bowl sanitizing apparatus which is not anticipated, rendered obvious, suggested, or even implied by any of the prior art toilet water sanitizers, either alone or in any combination thereof.

To attain this, the present invention generally comprises a toilet bowl sanitizing apparatus for mounting in a toilet. The toilet has a tank with an interior for selectively holding flushing water and a fill valve for controlling water flow from a water supply to the tank. A lever coupled to a float controls the fill valve. An upstanding overflow container is mounted in the tank and empties into a tank outlet. A trickle conduit is in communication with the fill valve for squirting water into the overflow container. The tank outlet is in fluid connection with a toilet bowl. The apparatus comprises a container which has a first end, a second end and a substantially hollow peripheral extending wall therebetween. The first end of the container has an opening therein and the second end is closed. A cap is adapted for mounting over the opening in the container. An intake pipe brings water into the container. The intake pipe is fluidly connected to the container. The trickle conduit has end adapted for connecting to the intake pipe. An outlet pipe is fluidly connected to the container. A plurality of sanitizing tablets sanitizes water flowing through the container. The outlet pipe is adapted for being placed in the overflow container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet bowl sanitizing apparatus apparatus and method which has many of the advantages of the toilet water sanitizers mentioned heretofore and many novel features that result in a new toilet bowl sanitizing apparatus which is not anticipated, rendered obvious, suggested, or even implied by any of the prior art toilet water sanitizers, either alone or in any combination thereof.

It is another object of the present invention to provide a new toilet bowl sanitizing apparatus which may be easily and efficiently manufactured and marketed.

It is a further object of the present invention to provide a new toilet bowl sanitizing apparatus which is of a durable and reliable construction.

An even further object of the present invention is to provide a new toilet bowl sanitizing apparatus which is susceptible of a low cost of manufacture with regard to both materials and labor, and which accordingly is then susceptible of low prices of sale to the consuming public, thereby making such toilet bowl sanitizing apparatus economically available to the buying public.

Still yet another object of the present invention is to provide a new toilet bowl sanitizing apparatus which provides in the apparatuses and methods of the prior art some of the advantages thereof, while simultaneously overcoming some of the disadvantages normally associated therewith.

Still another object of the present invention is to provide a new toilet bowl sanitizing apparatus for sanitizing water in the toilet bowl.

Yet another object of the present invention is to provide a new toilet bowl sanitizing apparatus which includes a toilet bowl sanitizing apparatus for mounting in a toilet. The toilet has a tank with an interior for selectively holding flushing water and a fill valve for controlling water flow from a water supply to the tank. A lever coupled to a float controls the fill valve. An upstanding overflow container is mounted in the tank and empties into a tank outlet. A trickle conduit is in communication with the fill valve for squirting water into the overflow container. The tank outlet is in fluid connection with a toilet bowl. The apparatus comprises a container which has a first end, a second end and a substantially hollow peripheral extending wall therebetween. The first end of the container has an opening therein and the second end is closed. A cap is adapted for mounting over the opening in the container. An intake pipe brings water into the container. The intake pipe is fluidly connected to the container. The trickle conduit has end adapted for connecting to the intake pipe. An outlet pipe is fluidly connected to the container. A plurality of sanitizing tablets sanitizes water flowing through the container. The outlet pipe is adapted for being placed in the overflow container.

Still yet another object of the present invention is to provide a new toilet bowl sanitizing apparatus that can be filled with tablets which are made for swimming pools and hot tubs.

Even still another object of the present invention is to provide a new toilet bowl sanitizing apparatus that leaves the sanitizing agent in the toilet bowl rather than only receiving sanitizing agents when the toilet is flushed which happen when the water is only sanitized within the tank of the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
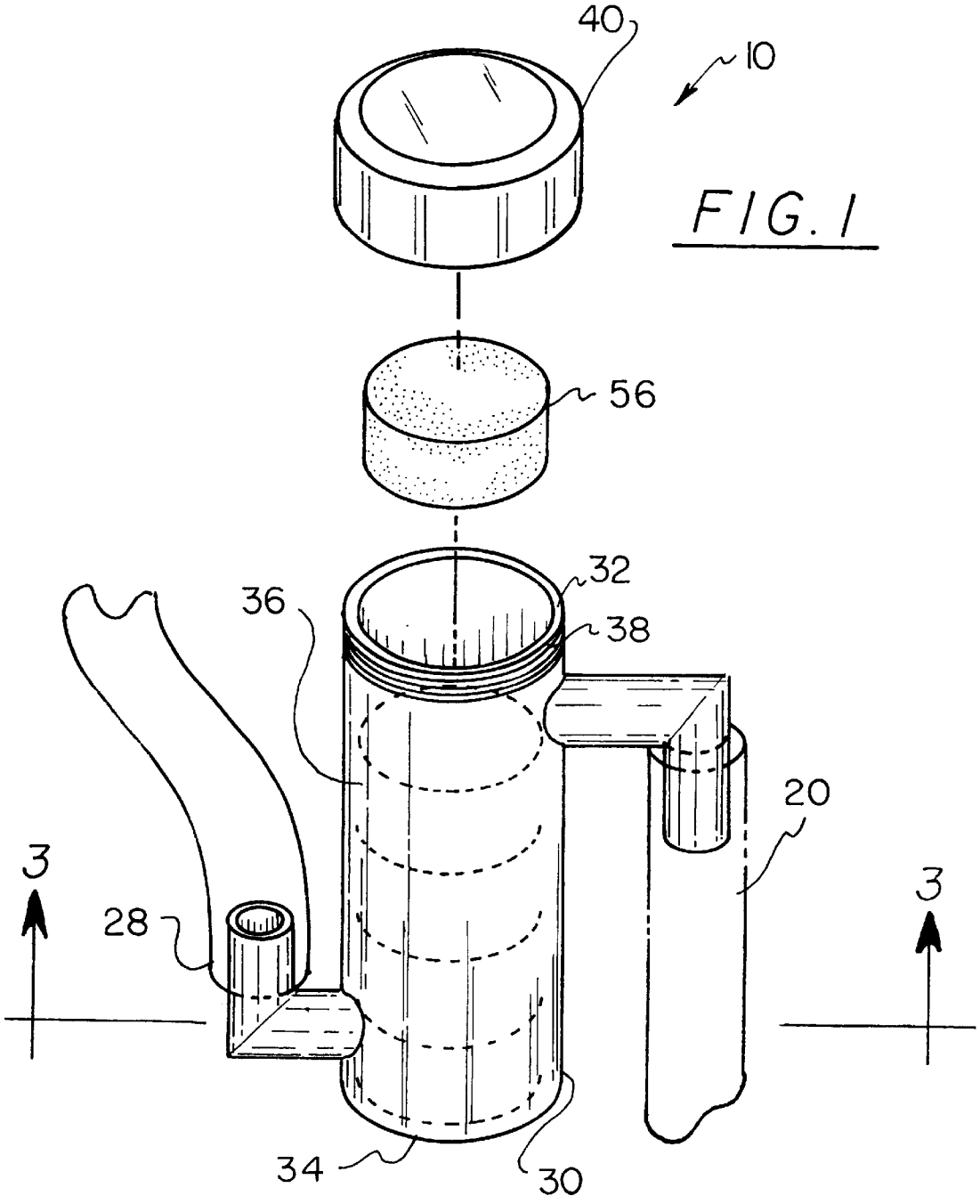
FIG. 1 is a schematic perspective view of a new toilet bowl sanitizing apparatus according to the present invention.
Figure 2:
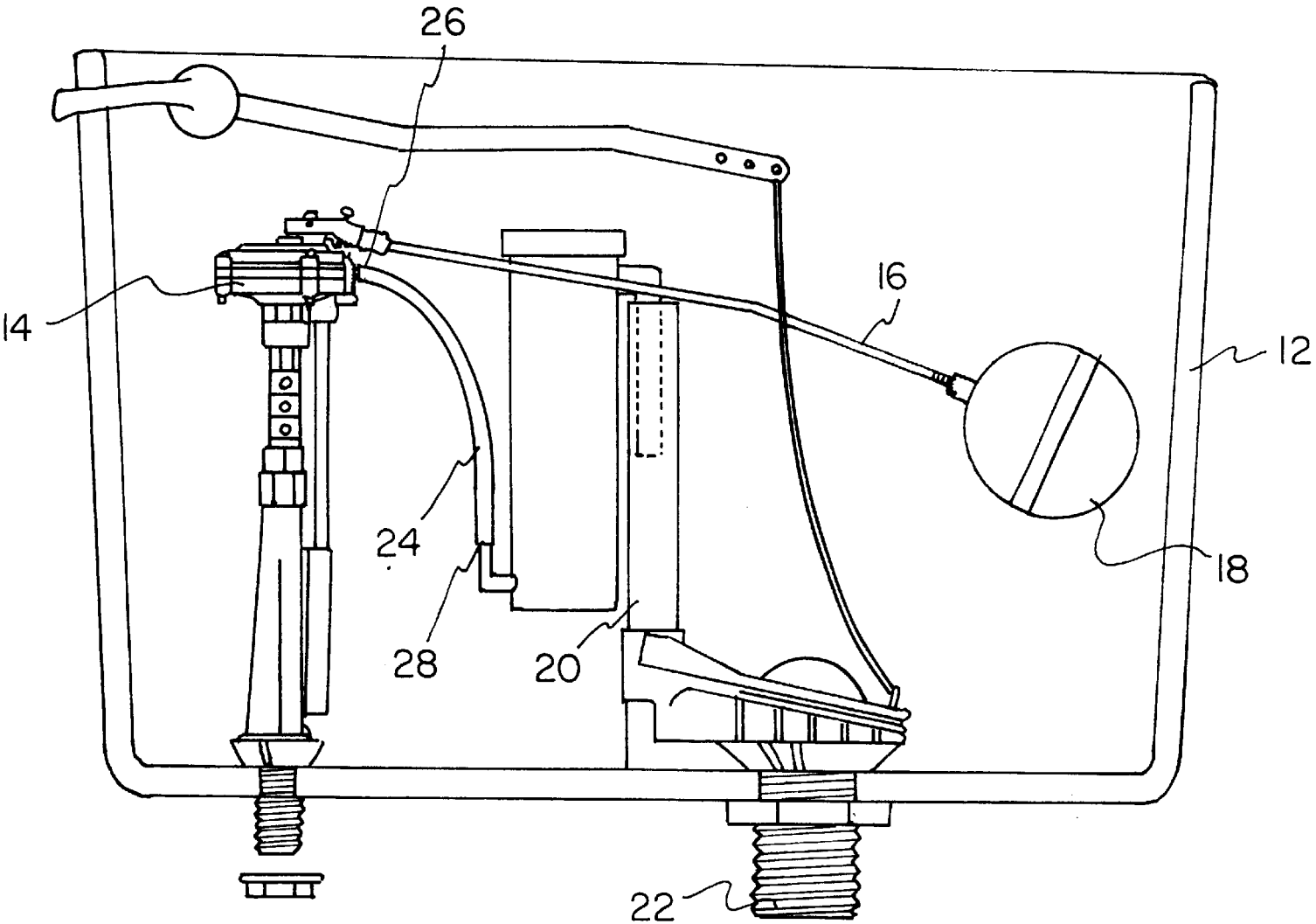
FIG. 2 is a schematic side view of a toilet holding the present invention.
Figure 4:
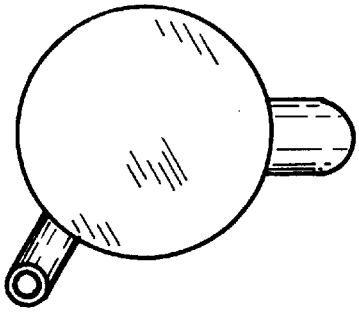
FIG. 4 is a schematic top view of the present invention.
Figure 3:
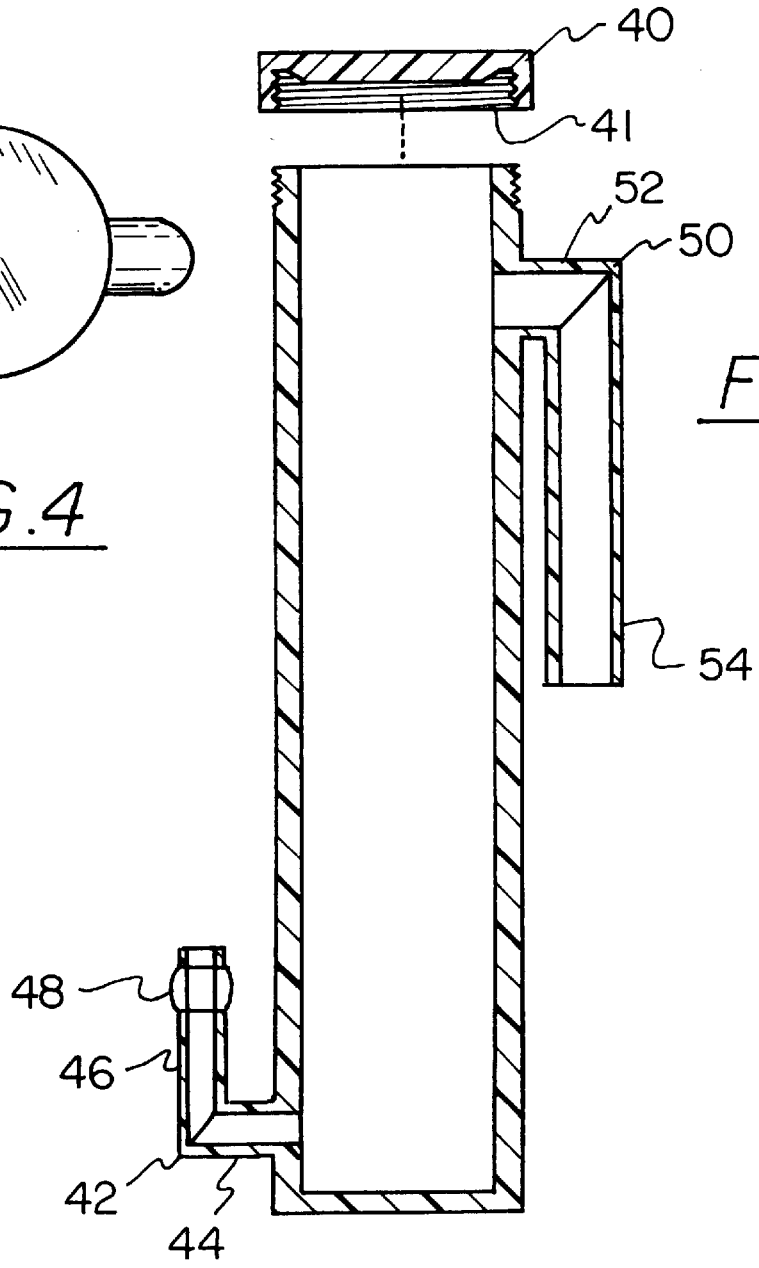
FIG. 3 is a schematic cross-sectional view taken along line 3—3 of the present invention.

With reference now to the drawings, and in particular to FIGS. 1 through 4 thereof, a new toilet bowl sanitizing apparatus embodying the principles and concepts of the present invention and generally designated by the reference numeral 10 will be described.

As best illustrated in FIGS. 1 through 4, the toilet bowl sanitizing apparatus 10 generally comprises a tank sanitizing apparatus for placement within a tank of a toilet.

The toilet has a tank 12. The tank 12 has an interior for selectively holding flushing water. A fill valve 14 for controlling water flow from a water supply to the tank is mounted in the tank 12. A lever 16, coupled to a float 18, controls the fill valve. An upstanding overflow container 20 empties into a tank outlet 22. The tank outlet 22 is in fluid connection with a toilet bowl, not shown. A trickle conduit 24 in communication with the fill valve 14 squirts water into the overflow container 20.

The tank sanitizing apparatus includes a container 30. The container has a first end 32, a second end 34 and a substantially hollow peripheral wall 36 extending therebetween. The first end 32 of the container has an opening therein. The second end 34 is closed. Preferably, the container 30 has a generally cylindrical shape. Ideally, the outside wall of the first end 32 has threads 38 thereon for receiving a cap 40.

A 40 cap is threaded 41 for mounting over the threaded opening in the container.

An intake pipe 42 brings water into the container 30. The intake pipe 42 is fluidly connected to the container 30 and is located generally adjacent to the second end 34 of the container. The intake pipe 42 has a first portion 44 extending generally perpendicularly away from the container. Preferably, the intake pipe bends 42 toward the first end of the container such that a second portion 46 of the intake pipe is oriented generally parallel with a longitudinal axis of the container 30.

A bulbous ridge 48 is located generally on an outer surface of the second portion 46 of the intake pipe 42 adjacent to an end of the intake pipe opposite an end of the intake pipe connected to the container.

The trickle conduit 24 has a first end 26 and a second end 28. The first end 26 of the trickle conduit 24 is coupled to the fill valve 14. The second end 28 of the trickle conduit 24 is placed over the ridge 48 such that the ridge 48 holds the second end of trickle conduit 24 in place.

An outlet pipe 50 is fluidly connected to the container 30. The outlet pipe 50 is located generally adjacent to the first end 32 of the container 30. Preferably, the outlet pipe 50 has a first portion 52 extending in a direction generally opposite to the intake pipe 50. Ideally, the intake pipe 50 bends toward the second end 34 of the container 30 such that a second portion 54 of the outlet pipe is generally oriented parallel with the longitudinal axis of the container 30.

A plurality of sanitizing tablets 56 for sanitizing water flowing through the container containing sanitizing chemicals. Preferably, the chemicals are either chlorine or bromine.

In use, the outlet pipe 50 is placed in the overflow container 20, and one or more of the sanitizing tablets are placed within the container. The trickle conduit 24 diverts a portion of the water supply into the intake pipe 42 such that water flows about the tablets and enters the toilet bowl via the outlet pipe and overflow container. Since this process takes place while the tank is filling, the toilet bowl will contain chemicals which will continually disinfect the toilet bowl.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet bowl sanitizing apparatus for mounting in a toilet, the toilet having a tank with an interior for selectively holding flushing water, a fill valve for controlling water flow from a water supply to the tank, the fill valve being controlled by a lever coupled to a float, an upstanding overflow conduit which empties into a tank outlet, a trickle conduit is in communication with the fill valve for squirting water into the overflow conduit, the tank outlet being in fluid connection with a toilet bowl, the apparatus comprising:

a container, said container having a first end, a second end and a substantially hollow peripheral extending wall therebetween, said first end of said container having an opening therein, said second end being closed;

a cap, said cap being adapted for mounting over said opening in said container;

an intake pipe for bringing water into said container, said intake pipe being fluidly connected to said container;

wherein said trickle conduit has end adapted for connecting to said intake pipe;

an outlet pipe, said outlet pipe being fluidly connected to said container;

a plurality of sanitizing tablets for sanitizing water flowing through said container;

wherein said outlet pipe is adapted for being placed in said overflow conduit; and said outlet pipe being located generally adjacent to said first end of said container, said outlet pipe having a first portion extending in a direction generally opposite to said intake pipe, said outlet pipe bending toward said second end of said container such that a second portion of said outlet pipe is generally oriented parallel with said longitudinal axis of said container such that an end of said outlet pipe is insertable into the upstanding overflow conduit and supports said container in the interior of said tank.

2. A toilet bowl sanitizing apparatus for mounting in a toilet as in claim 1, the apparatus further comprising:

a toilet having a tank with an interior for selectively holding flushing water, a fill valve for controlling water flow from a water supply to the tank, said fill valve being controlled by a lever coupled to a float, an upstanding overflow conduit which empties into a tank outlet, a trickle conduit being in communication with said fill valve for squirting water into said overflow conduit, the tank outlet being in fluid connection with a toilet bowl.

3. A toilet bowl sanitizing apparatus for mounting in a toilet as in claim 2, further comprising:

a ridge, said ridge being bulbous, said ridge being located generally on an outer surface of a second portion of said intake pipe adjacent to an end of said intake pipe opposite an end of said intake pipe connected to said container; and wherein said trickle conduit is adapted to fit over said ridge such that said ridge holds said trickle conduit in communication with said intake pipe.

4. A toilet bowl sanitizing apparatus for mounting in a toilet as in claim 1, wherein said intake pipe is located generally adjacent to said second end of said container, said intake pipe having a first portion extending generally perpendicularly away from said container, said intake pipe a second portion of said intake pipe is oriented generally parallel with a longitudinal axis of said container.

5. A toilet bowl sanitizing apparatus for mounting in a toilet as in claim 1, wherein said sanitizing comprise chemicals selected from the group consisting of chlorine and bromine.

6. A toilet bowl sanitizing apparatus for mounting in a toilet, the apparatus comprising:

a toilet having a tank with an interior for selectively holding flushing water, a fill valve for controlling water flow from a water supply to the tank, said fill valve being controlled by a lever coupled to a float, an upstanding overflow conduit which empties into a tank outlet, a trickle conduit being in communication with said fill valve for squirting water into said overflow conduit, the tank outlet being in fluid connection with a toilet bowl;

a container, said container having a first end, a second end and a substantially hollow peripheral extending wall therebetween, said first end of said container having an opening therein, said second end being closed, said container having a generally cylindrical shape;

a cap, said cap being threaded for mounting over said opening in said container;

an intake pipe for bringing water into said container, said intake pipe being fluidly connected to said container, said intake pipe being located generally adjacent to said second end of said container, said intake pipe having a first portion extending generally perpendicularly away from said container, said intake pipe bending toward said first end of said container such that a second portion of said intake pipe is oriented generally parallel with a longitudinal axis of said container;

a ridge, said ridge being bulbous, said ridge being located generally on an outer surface of said second portion of said intake pipe adjacent to an end of said intake pipe opposite an end of said intake pipe connected to said container;

said trickle conduit having a first end and a second end, said first end of said trickle conduit being coupled to said fill valve, said second end of said trickle conduit being placed over said ridge such that said ridge holds said second end of said trickle conduit in place;

an outlet pipe, said outlet pipe being fluidly connected to said container, said outlet pipe being located generally adjacent to said first end of said container, said outlet pipe having a first portion extending in a direction generally opposite to said intake pipe, said outlet pipe bending toward said second end of said container such that a second portion of said outlet pipe is generally oriented parallel with said longitudinal axis of said container such that an end of said outlet pipe is insertable into the upstanding overflow conduit and supports said container in the interior of said tank;

a plurality of sanitizing tablets for sanitizing water flowing through said container, said sanitizing tablets containing chemicals selected from the group consisting of chlorine and bromine;

wherein said outlet pipe is placed in said overflow conduit, wherein said sanitizing tablets are placed within said container, wherein said trickle conduit diverts a portion of the water supply into said intake pipe such that water flows about said tablets and enters the toilet bowl via said outlet pipe and overflow conduit.

* * * * *